US005183248A

United States Patent [19]

Okada et al.

[11] Patent Number: 5,183,248

[45] Date of Patent: Feb. 2, 1993

[54] SHEET FEEDING DEVICE

[75] Inventors: Hiromi Okada, Nara; Masao Otsuka, Ashiya, both of Japan

[73] Assignee: Mita Industrial Co., Ltd., Osaka, Japan

[21] Appl. No.: 886,606

[22] Filed: May 21, 1992

Related U.S. Application Data

[63] Continuation-in-part of Ser. No. 570,600, Aug. 21, 1990, abandoned.

[30] Foreign Application Priority Data

Aug. 28, 1989 [JP] Japan ..... 1-222674

[51] Int. Cl.[5] ..... B65H 1/08

[52] U.S. Cl. ..... 271/127; 271/160; 271/121

[58] Field of Search ..... 271/10, 18, 121, 123, 271/126, 127, 160, 167, 169, 182, 280

[56] References Cited

U.S. PATENT DOCUMENTS 4,394,009 7/1983 Bergman .
4,395,036 7/1983 Bergman .
4,647,030 3/1987 Tomita .
4,662,536 5/1987 Powers .
4,995,601 2/1991 Ohashi .

FOREIGN PATENT DOCUMENTS 63-225043 9/1988 Japan .
63-225044 9/1988 Japan .
1-34820 2/1989 Japan .
1-104537 4/1989 Japan .
1-156239 6/1989 Japan .
1-288532 11/1989 Japan .

OTHER PUBLICATIONS

IBM Technical Disclosure Bulletin by T. E. Wilson, vol. 24, No. 7B, dated Dec., 1981.

*Primary Examiner*—H. Grant Skaggs
*Attorney, Agent, or Firm*—Beveridge, DeGrandi, Weilacher & Young

[57] ABSTRACT

When a sheet feeding cassette (10) is mounted on an image forming apparatus or the like, a forward portion of a mounting plate (13) is urged upward so that an upper surface of the forward portion of the mounting plate (13) is brought into contact with a feed roller (11). A pair of non-slip pads (14*a*) and (14*b*) is affixed to the upper surface of the forward portion of the mounting plate (13). The non-slip pads (14*a*) and (14*b*) are members each having a plane shape of approximately L or its reversed shape and made of, for example, a rubber plate.

The non-slip pads (14*a*) and (14*b*) are affixed to such a position that they do not come into direct contact with the feed roller (11). Consequently, when sheets are fed, the last sheet is not directly nipped strongly by the feed roller and the non-slip pads, to produce no buzzing noise. In addition, the non-slip pads (14*a*) and (14*b*) are in the vicinity of the feed roller (11). Accordingly, the non-slip pads (14*a*) and (14*b*) perform the function of preventing the last sheet from being fed together with the other sheets if the number of the sheets is reduced, that is, preventing the sheets from being fed together.

11 Claims, 8 Drawing Sheets

SHEET FEEDING DEVICE

The present invention is a continuation in part, and its parent application is U.S. Pat. Ser. No. 07/570,600 (filed on Aug. 21, 1990), now abandoned.

BACKGROUND OF THE INVENTION

1. Field of the Invention

The present invention relates to an improvement of a sheet feeding device mounted on an image forming apparatus or the like.

2. Description of the Prior Art

For example, an image forming apparatus such as a copying machine or a printer requires sheets (transfer paper, sensitizing paper, thermosensible paper or the like) on which an image is formed. A sheet feeding cassette detachable from the main body of the apparatus has been known as a device for feeding the sheets.

The sheet feeding cassette can contain a plurality of sheets. When the sheet feeding cassette is mounted on the image forming apparatus, the sheets are fed one at a time by a feed roller provided in the main body of the apparatus. In order to feed the sheets by the feed roller, supply pressure must be applied to the sheets with front ends of the sheets pressed to the feed roller. If supply pressure is applied, the friction force is produced between the feed roller and the sheets. The sheets can be fed by rotating the feed roller in the state.

Accordingly, in order to apply supply pressure to the sheets, the sheet feeding cassette is generally provided with a mounting plate 1, as shown in FIG. 1. The mounting plate 1 is so adapted that its forward portion can be moved up and down centered with respect to its rear end and is urged upward by a spring 2. Since the sheets contained in a cassette case 3 are mounted on this mounting plate 1, the front ends of the sheets are pushed upward by the mounting plate 1 to be brought into contact with a feed roller 4.

A non-slip pad 5 having a high coefficient of friction is affixed to an upper surface of the forward portion of the mounting plate 1. The non-slip pad 5 is affixed in such a position that it comes into contact with the feed roller 4 when there remain no sheets. The non-slip pad 5 is used for holding the friction force between the sheets and the mounting plate 1 when there remain a few sheets on the mounting plate 1 to prevent the remaining sheets from being fed at one time.

The foregoing will be described in more detail. It is assumed that the non-slip pad 5 is not provided on the mounting plate 1. In this case, the friction force between the last sheet and the mounting plate 1 is smaller than the friction force between the sheets. Accordingly, if there remain a few sheets, for example, there remain five or six sheets, the situation is often encountered where no slip occurs between the sheets where the friction force is large but slip occurs between the last sheet and the mounting plate 1 where the friction force is small so that five or six sheets are fed at one time.

Consequently, the non-slip pad is an indispensable member to prevent, when there remain a few sheets, the remaining sheets from being fed at one time.

However, the conventional sheet feeding cassette having the above described non-slip pad has the disadvantage in that buzzing noise is liable to be produced in feeding the last sheet.

Buzzing noise is mainly produced by friction between the non-slip pad and the last sheet. Accordingly, if the non-slip pad 5 is eliminated, no buzzing noise is produced. However, when there remain a few sheets in the sheet feeding cassette, the remaining sheets are liable to be fed at one time, as described above.

Therefore, the non-slip pad cannot be eliminated. Accordingly, it is desired to prevent buzzing noise from being produced with the non-slip pad being left.

SUMMARY OF THE INVENTION

The present invention has been made under the above described background and has for its object to provide a sheet feeding device eliminating the possibility of producing buzzing noise and capable of feeding, even if there remain a few sheets, the sheets one at a time until the last sheet has been fed.

Briefly stated, the present invention provides a sheet feeding device adapted, by devising the position, to which a non-slip member is affixed, on an upper surface of a forward portion of a mounting plate and the shape of the non-slip member, to produce no buzzing noise in feeding the last sheet and not to feed, even if there remain a few sheets on the mounting plate, the remaining sheets at one time by preventing the last sheet from being fed together with the other sheets until there remains only the last sheet.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
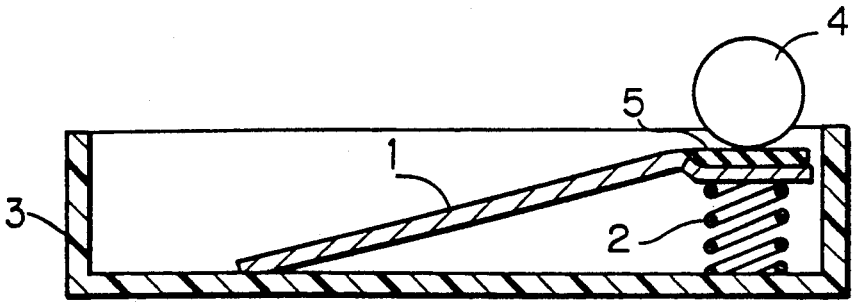
Prior Art Fig.1
FIG. 1 is a sectional side elevation view showing an example of the construction of a conventional sheet feeding cassette.
Figure 2:
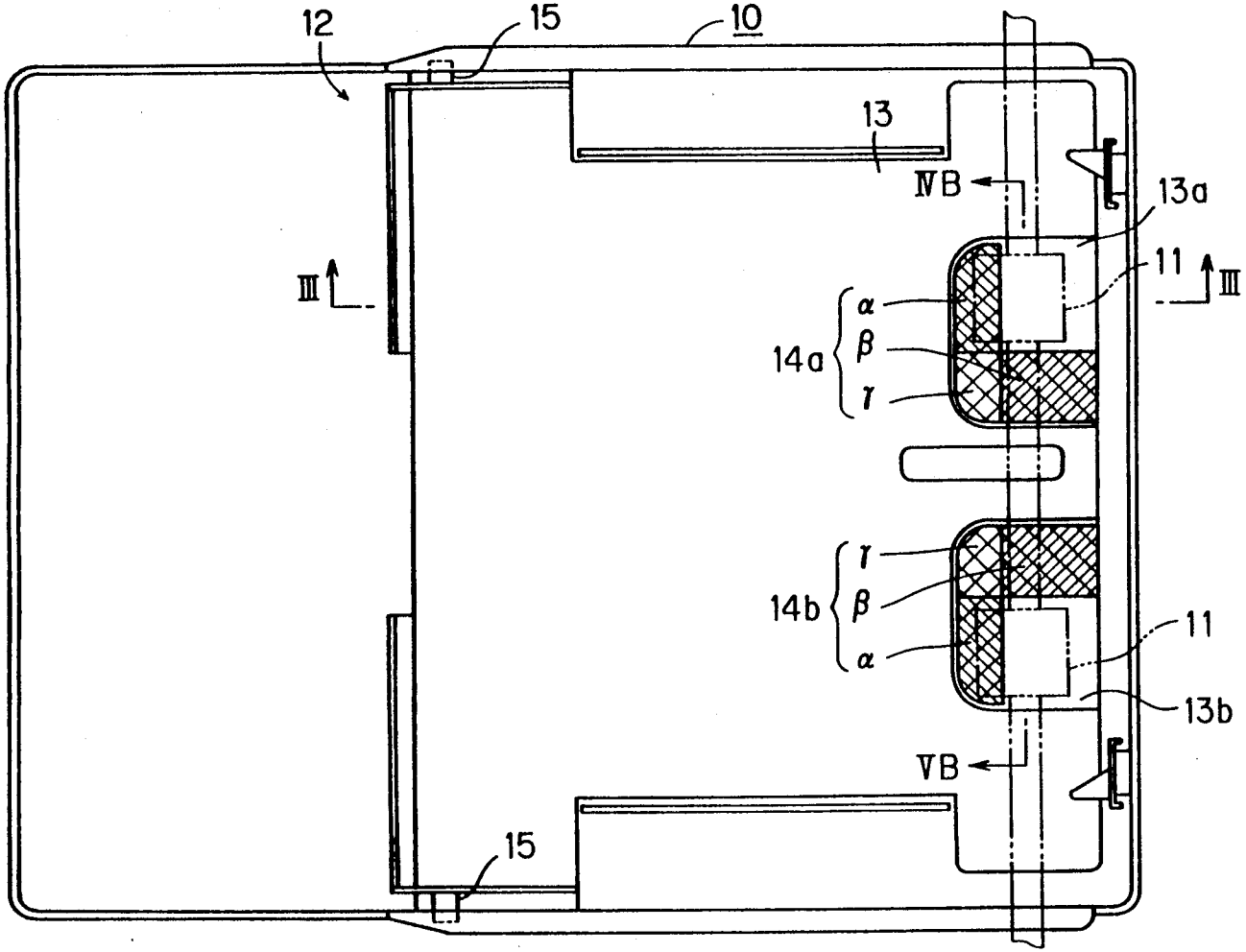
FIG. 2 is a plan view showing a sheet feeding cassette according to one embodiment of the present invention.

FIG. 2 is a plan view showing the state of a sheet feeding cassette according to one embodiment of the present invention as viewed from above, where the position of a feed roller 11 in a case where it is mounted on an image forming apparatus is represented by a two-dot and dash line.

Figure 3:
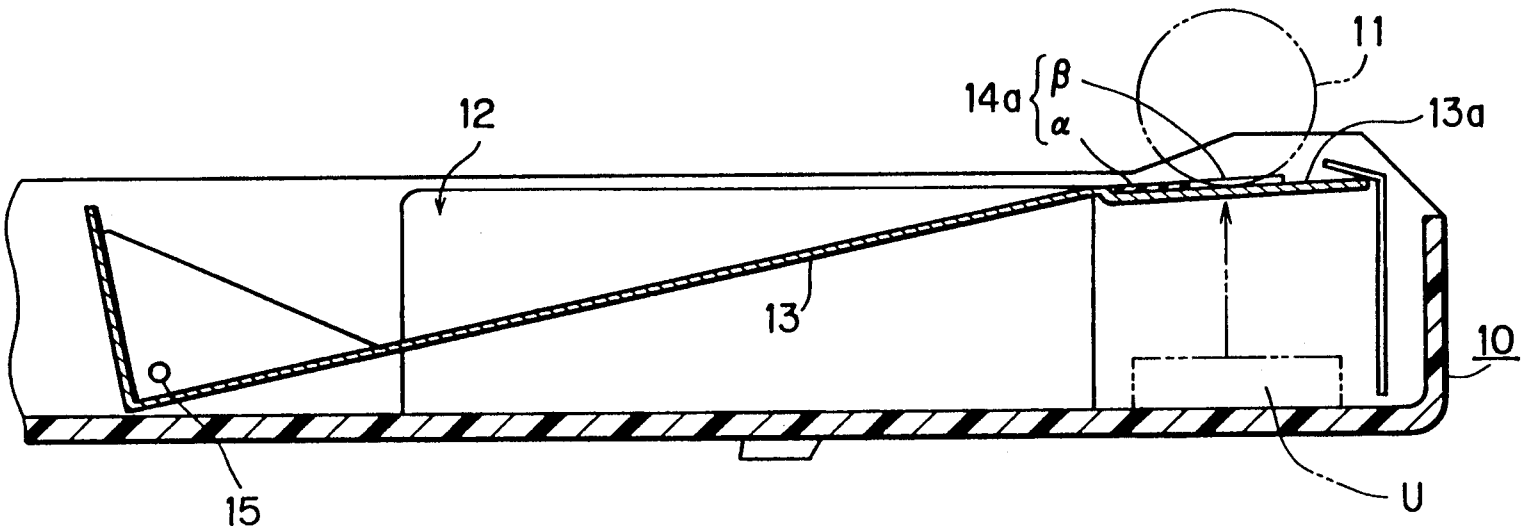
FIG. 3 is a cross sectional view taken along a line III—III shown in FIG. 2.

FIG. 3 is a cross sectional view taken along a line III—III shown in FIG. 2.

Referring now to FIGS. 2 and 3, a sheet containing section 12 in a sheet feeding cassette 10 is provided with a mounting plate 13. The mounting plate 13 is a plate-shaped member for mounting sheets contained in the sheet containing section 12. The mounting plate 13 is provided with a supporting shaft 15 in its rear end (on the left in FIGS. 2 and 3) and can be shaken around the supporting shaft 15. When the sheet feeding cassette 10 is mounted on the image forming apparatus, a forward portion of the mounting plate 13 is upwardly urged by a urging means illustrated by two-dot and dash lines U, so that an upper surface of the forward portion of the mounting plate 13 is brought into contact with a peripheral surface of the feed roller 11. The urging means U may be in the form of a spring provided with the image forming apparatus, or a spring disposed on the cassette 10.

A pair of dents 13*a* and 13*b* is formed on the upper surface of the forward portion of the mounting plate 13, and a pair of non-slip pads 14*a* and 14*b* is affixed to the the pair of dents 13*a* and 13*b*. The non-slip pads 14*a* and 14*b* are arranged in bilaterally symmetrical positions with respect to the center line of the sheet feeding cassette 10 in the width direction and have bilaterally symmetrical shapes. Each of the non-slip pads 14*a* and 14*b* is made of a member having a plane shape of approximately L or its reversed shape and having a high coefficient of friction, for example, rubber.

The present embodiment is characterized in that each of the non-slip pads 14*a* and 14*b*, which is affixed to such a position that it does not come into direct contact with the two feed rollers 11 and 11 as shown in FIG. 2, includes a base portion $\alpha$ located backward of the two feed rollers 11 and 11 in the sheets feeding direction and a facing portion $\beta$ facing to the feed rollers axis and locating aside the rollers 11 and 11. In other words, each of the non-slip pads 14*a* and 14*b* is affixed to a portion excluding a portion with which the feed rollers 11 and 11 come into direct contact. Particularly, each of the facing portions $\beta$ is so located between the rollers 11 and 11 as to along with the roller axis, so that the facing portions $\beta$ play very important role in order to prevent the sheets from being fed at the excess amount, as described wherein later. As shown in FIG. 2, the base portions $\alpha$ in the present embodiment are integrally connected through connecting portions $\gamma$ with the facing portions $\beta$.

Although in the present embodiment, the non-slip pads 14*a* and 14*b* are affixed to the dents 13*a* and 13*b*, the non-slip pads may be affixed to the upper surface of the forward portion of the mounting plate 13 with no dents being formed thereon.

Figure 4A:
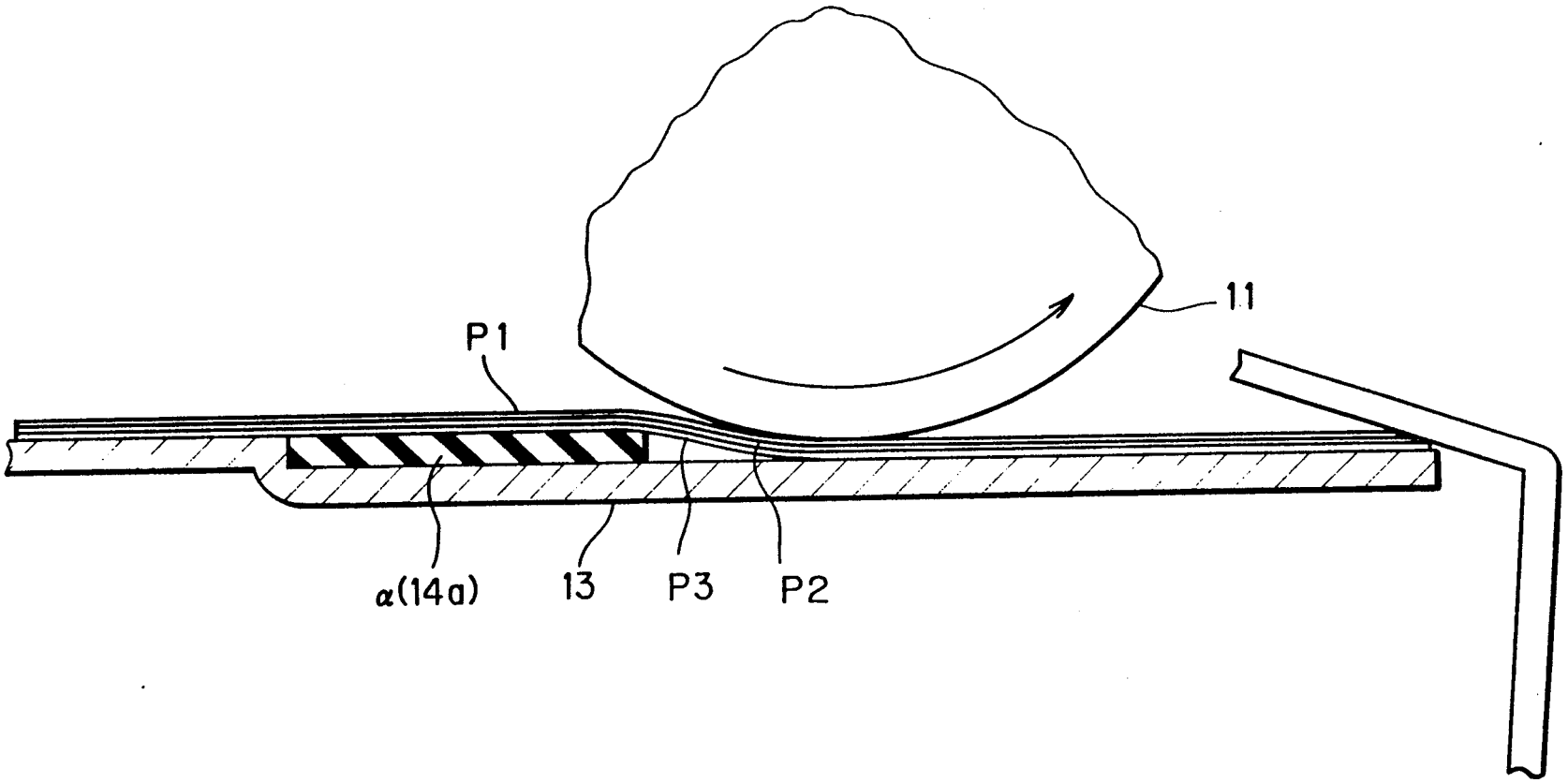
FIG. 4A is an enlarged view showing main parts of the sheet feeding cassette shown in FIG. 3.

FIG. 4A is an enlarged fragmentary sectional view showing the state of sheets, the feed roller 11 and the non-slip pad 14*a* in a case where there remain a few sheets on the mounting plate 13. The existence of the non-slip pad 14*a* prevents a plurality of sheets P1, P2 and P3 from being simultaneously fed in a case where the number of sheets is reduced. In this case, a small step is formed between the position where the sheets P1, P2 and P3 are nipped and a front edge of the non-slip pad 14*a* positioned in its vicinity. However, this small step is useful for preventing the last sheet P3 from being fed together with the sheet P2 thereon when there remain a few sheets.

More specifically, the last sheet P3 is pressed against the front edge of the non-slip pad 14*a* due to the above described step and to the toughness of the sheet P3 when the sheet P2 on the last sheet P3 is fed by the feed roller 11. Consequently, the friction force produced between the last sheet P3 and the front edge of the non-slip pad 14*a* becomes larger than the friction force between the last sheet P3 and immediate next upper sheet P2 or sheets, so that the last sheet P3 is not fed together with the sheet P2 thereon.

As in the present embodiment, if the non-slip pad 14*a* is provided in such a position that it does not come into direct contact with the feed roller 11, the last sheet P3 is not directly nipped strongly by the feed roller 11 and the non-slip pad 14*a* when the last sheet P3 is fed, so that buzzing noise which has been conventionally produced by the strong nip is not produced. On the other hand, the non-slip pad 14*a* is not directly pressed against the feed roller 11. However, the last sheet P3 comes into full contact with an upper surface of the non-slip pad 14*a*. In particular, the last sheet P3 is strongly pressed against the vicinity of the front edge of the non-slip pad 14*a*. Accordingly, the non-slip pad 14*a* performs its inherent function, that is, the function of not feeding the last sheet P3 together with the remaining sheets P1 and P2. Consequently, when there remain a few sheets in the sheet feeding cassette 10, the remaining sheets are not fed at one time.

The base portion $\alpha$ functions itself to prevent the buzzing noise when the sheets are fed and to prevent the sheets from being fed at the excess amount even when the sheets run short.

However, the base portion $\alpha$ will not enough to prevent excess of the feeding amount of sheet under such wrong conditions as changeable humidity or temperature or long continuous services. As shown in FIG. 4A, when the sheets run short, the pinching force by the roller 11 and the pad 14*a* can only be applied at the vicinity of a tip portion of the base portion $\alpha$, so that the friction force which should be applied between the last sheet P3 and pad 14*a* can not be generated sufficiently.

As a matter of fact, when the inventors of the present invention carried out an expeiment on the base portion $\alpha$ in order to complete the invention, they found that the base portion $\alpha$ is not sufficient to prevent excess of the feeding amount of sheet.

Figure 4B:
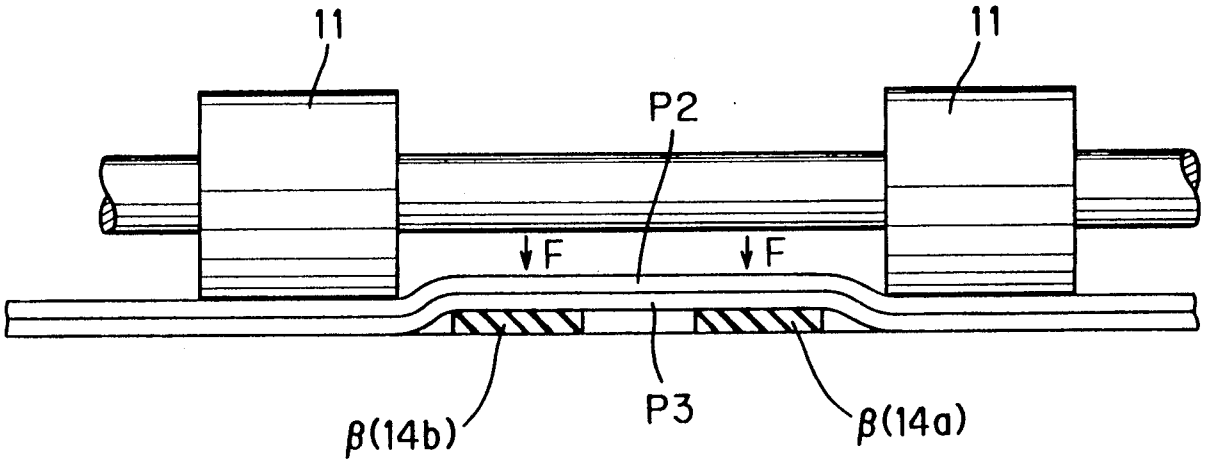
FIG. 4B is a cross sectional view taken along a line IVB—IVB shown FIG. 2.

Therefore, according to the present embodiment as shown in FIG. 4B, the pads 14*a* and 14*b* are provided with the facing portions $\beta$ so located aside the rollers 11 and 11 as to along with the roller axis. Consequently, because the rollers 11 and 11 compress the sheets aside the facing portions $\beta$, the sufficient friction force can be generated between the last sheet P3 and the facing portions $\beta$ due to the compression force applied onto all sheets P2 and P3 by the rollers 11 and 11 between which the facing portions $\beta$ cause to bias the last sheet P3 upwardly by its thickness. Thus, excess of the feeding amount of sheet can be prevented sufficiently.

Figure 5A:
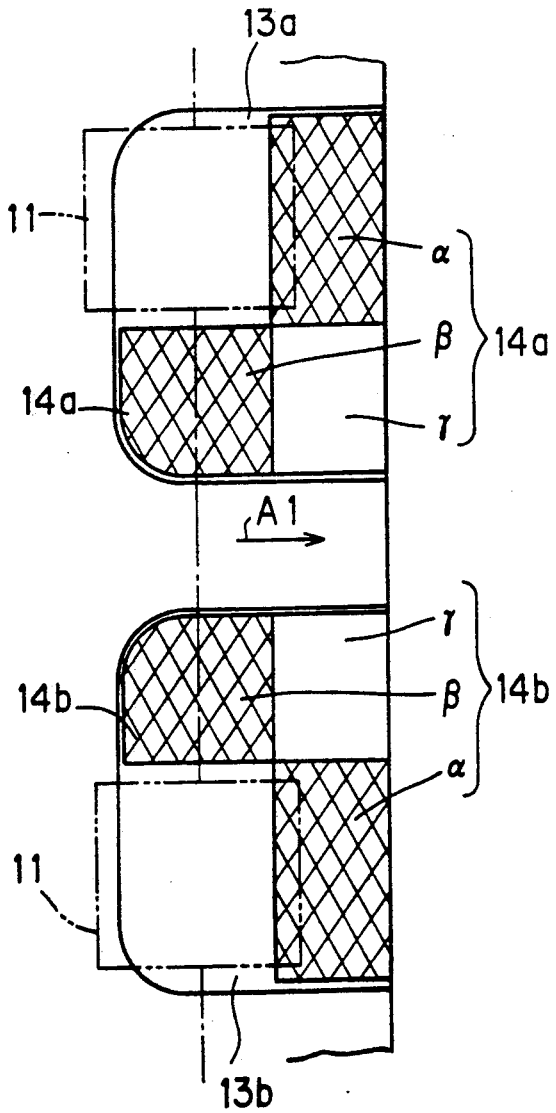
FIGS. 5A and 5B are plan views showing other shapes of non-slip pads.
Figure 5B:
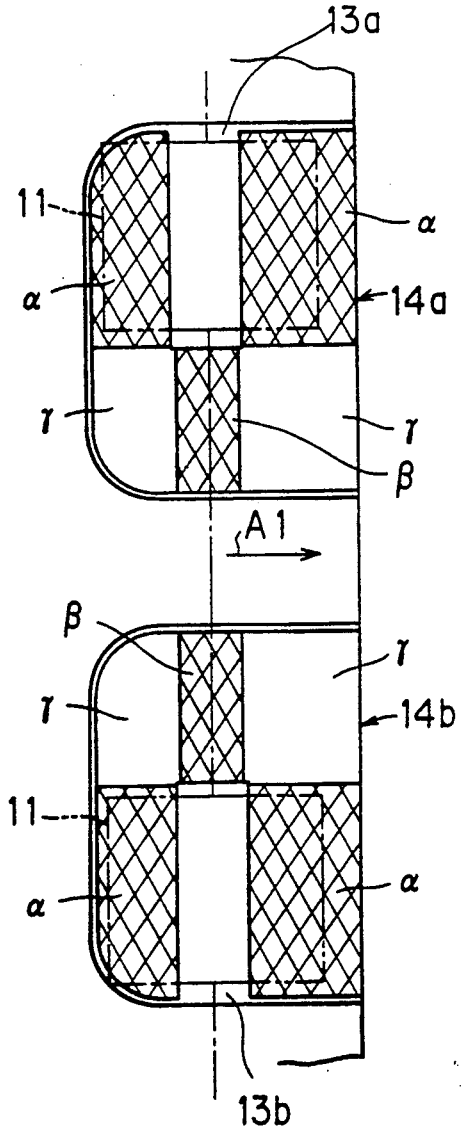

FIGS. 5A and 5B are plan views showing other examples of the non-slip pads.

Referring to FIG. 5A, non-slip pads 14*a* and 14*b* affixed to the mounting plate 13 have base portions $\alpha$ located the forward of a corresponding roller 11 in the sheets feeding direction and facing portions $\beta$ located aside the roller 11.

Referring likewise to FIG. 5B, non-slip pads 14*a* and 14*b* affixed to the mounting plate 13 have base portions $\alpha$ located the forward and backward of a corresponding roller 11 in the sheets feeding direction and facing portions $\beta$ located aside the roller 11.

In both embodiments in FIGS. 5A and 5B, the base portions $\alpha$ are integrally formed through connecting portions $\gamma$ with the facing portions $\beta$.

It is needless to say that the non-slip pads may be in such an arbitrary shape as far as each pad includes a base portion located forward or backward of two feed rollers in the sheets feeding direction and a facing portion facing to the feed rollers axis aside the rollers.

Figure 6:
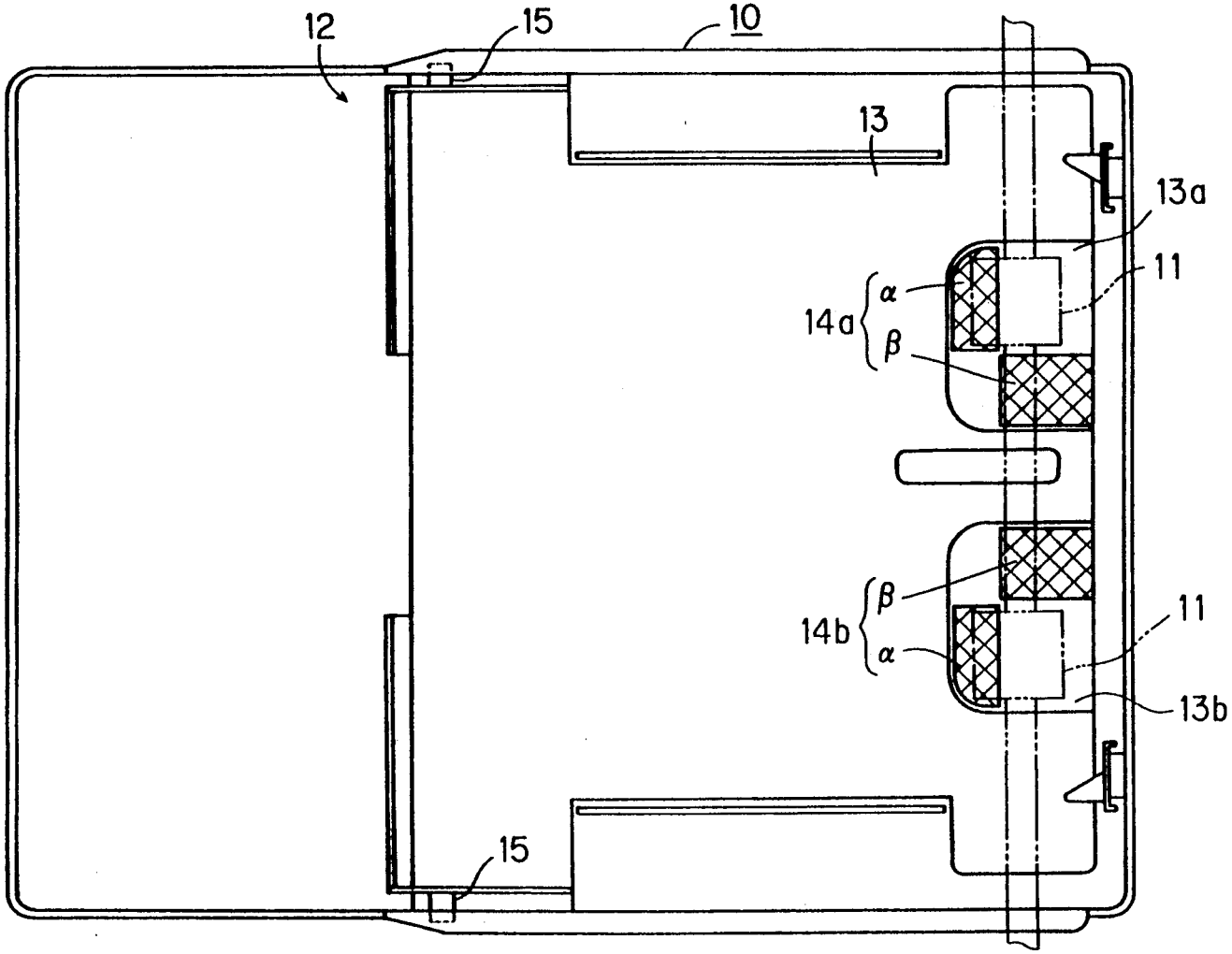
FIG. 6 a plan view showing a sheet feeding cassette according to another embodiment of the present invention.

As shown in FIG. 6, each of the portions $\alpha$ and $\beta$ may be separately forming the non-slip pads 14*a* and 14*b*.

Although description was made of one embodiment by taking a sheet feeding cassette as an example, it should be noted that the present invention is not limited to the sheet feeding cassette. For example, the present invention can be also applied to a sheet feeding device having as a mounting plate a deck which can be raised and lowered by power.

Figure 7:
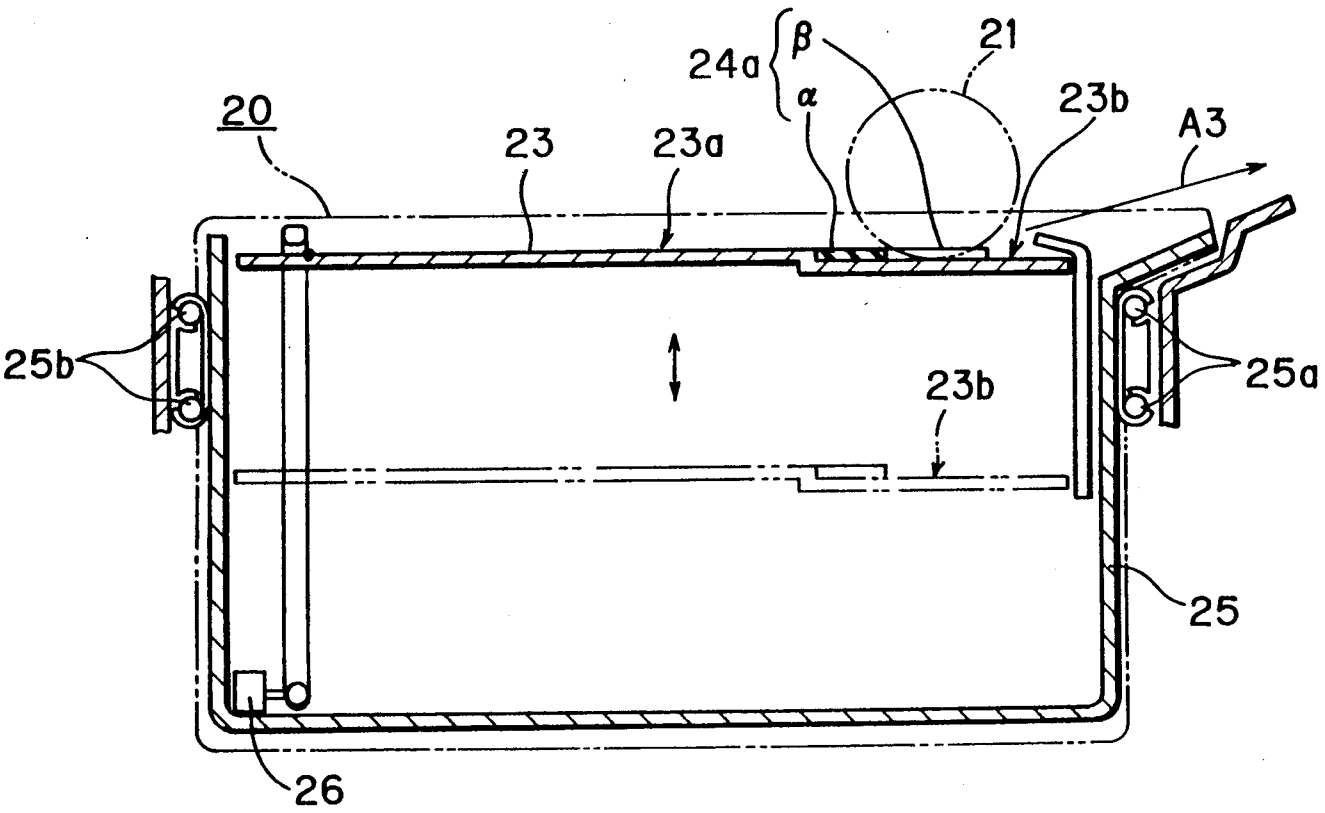
FIG. 7 is a diagrammatical cross sectional view showing a sheet feeding device according to another embodiment of the present invention.

FIG. 7 is a diagrammatical cross sectional view showing a sheet feeding device 20 according to another embodiment of the present invention. Referring to FIG. 7, the sheet feeding device 20 is provided with a sheet container 25. The container 25 is so adapted that it can be guided to rails 25*a* and 25*b* respectively connected to the front side of the sheet feeding device 20 (on the right in FIG. 7) and the rear side thereof (on the left in FIG. 7) and can be pulled out on this side perpendicular to FIG. 7. The sheet container 25 is provided with a deck 23. The deck 23 is a plate-shaped member for mounting sheets. The deck 23 is connected to an up-and-down device 26 illustrated schematically and is raised and lowered with it being in a horizontal state by driving of, for example, a motor included in the up-and-down device.

Although the construction of the sheet feeding device 20 to which the present invention can be applied is not limited to the above described construction, the sheet feeding device 20 may be of another construction.

The sheet feeding device 20 according to the present embodiment is characterized in that a non-slip pad 24 affixed to the surface of the deck 23 on its forward side is arranged in such a position that it does not come into direct contact with a feed roller 21. More specifically, the sheet feeding device 20 can be mounted on, for example, a copying machine, and the feed roller 21 in the copying machine is engaged with the deck 23 in a position represented by two dot lines in a state where it is mounted. Sheets mounted on the deck 23 are fed one at a time in a direction represented by an arrow A3 by the rotation of the feed roller 21 and are accepted in the copying machine.

In the sheet feeding device 20 according to the present embodiment, an auxiliary surface 23*b* lower than a major surface 23*a* of the deck 23 by one step is formed on its forward side and a non-slip pad 24 is affixed to the auxiliary surface 23*b*. More specifically, the non-slip pad 24 is affixed to the auxiliary surface 23*b* along a side of the step between the major surface 23*a* and the auxiliary surface 23*b*. The height of the surface of the non-slip pad 24 is made equal to that of the major surface 23*a*. As well as the embodiment in FIG. 2, the non-slip pad 24 includes a base portion $\alpha$ and a facing portion $\beta$ which are integrally connected with each other.

In place of such construction, the surface of the deck 23 may be made flat and the non-slip pad 24 may be so affixed as to be projected from the surface by its thickness.

If the sheet feeding device according to the present invention is constructed as, for example, a sheet feeding cassette, the sheet feeding cassette may be independently an object of transaction and sold or it may be provided as an accessory in a particular apparatus.

The same is true for a sheet feeding device having a deck which can be raised and lowered.

Furthermore, the present invention is not limited to a sheet feeding device for an image forming apparatus. For example, the present invention can be widely applied to a sheet feeding device utilized when sheets must be continuously or intermittently fed.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A sheet feeding device in which a plurality of sheets can be contained and from which the sheets can be fed one by one by at least two feed rollers when the sheet feeding device is mounted on an apparatus, comprising:

a sheet containing section for containing the sheets;

a mounting means for mounting the sheets arranged in said sheet containing section, wherein at least a forward portion of said mounting means in the direction in which sheets are fed is movable up and down, and wherein a facing position of the forward portion of said mounting means comes into direct contact with the each feed rollers when no sheets are contained in said containing section;

an urging means for urging said mounting means upward at least when the sheets are fed, such that the sheets are brought into contact with the each feed rollers; and a non-slip means arranged on an upper surface of the forward portion of said mounting means, wherein said non-slip means is in contact with a last sheet mounted on said mounting means, had said non-slip means including a base portion which locates forward or backward of the two feed rollers in the sheets feeding direction and a facing portion facing to the roller axis aside the two rollers and being arranged in such a position that it does not come into direct contact with said two feed rollers even when no sheets are contained in said sheet containing section.

2. The sheet feeding device according to claim 1, wherein an edge of said non-slip means is positioned in a vicinity of the position where a feed roller nips the sheets in feeding the sheets.

3. The sheet feeding device according to claim 2, wherein a step is formed between the position where the feed roller nips the sheets and the edge of said non-slip means when a few sheets remain mounted on the mounting means.

4. The sheet feeding device according to claim 1, wherein said non-slip means includes a sheet-shaped member having an arbitrary plane shape and having a predetermined thickness.

5. The sheet feeding device according to claim 4, wherein said non-slip means includes two sheet-shaped members which are arranged in bilaterally symmetrical positions in a direction at right angles to the direction in which sheets are fed.

6. The sheet feeding device according to claim 5, wherein said sheet-shaped members arranged in bilaterally symmetrical positions have plane shapes which are bilaterally symmetrical.

7. The sheet feeding device according to claim 1, wherein said base and facing portions are integrally forming said non-slip pads.

8. The sheet feeding device according to claim 1, wherein said base and facing portions are separately forming said non-slip pads.

9. A sheet feeding cassette in which a plurality of sheets can be contained and from which the sheets can be fed one by one by at least two feed rollers when the sheet feeding cassette is mounted on an apparatus, comprising:

a sheet containing section for containing the sheets;

a mounting means for mounting the sheets arranged in said sheet containing section, wherein at least a forward portion of said mounting means in the direction in which sheets are fed is movable up and down, and wherein a facing position of the forward portion of said mounting means comes into direct contact with the each feed rollers when no sheets are contained in said containing section;

an urging means for urging said mounting means upward at least when the sheets are fed, such that the sheets are brought into contact with the each feed rollers; and a non-slip means arranged on an upper surface of the forward portion of said mounting means, wherein said non-slip means is in contact with a last sheet mounted on said mounting means, and said non-slip means including a base portion which locates forward or backward of the two feed rollers in the sheets feeding direction and a facing portion facing to the roller axis aside the two rollers and being arranged in such a position that it does not come into direct contact with said two feed rollers even when no sheets are contained in said sheet containing section.

10. The sheet feeding cassette according to claim 9, wherein said non-slip means is so adapted that its edge is positioned in the vicinity of the position where said feed roller nips the sheets and is affixed to the mounting means with a step being formed therebetween such that the surface of said non-slip means is slightly higher than the surface of the mounting means.

11. A sheet feeding cassette in which a plurality of sheets can be contained and from which the sheets can be fed one by one by at least two feed rollers when the sheet feeding cassette is mounted on an apparatus, comprising:

a sheet containing section for containing the sheets;

a mounting means for mounting the sheets arranged in said sheet containing section, wherein at least a forward portion of said mounting means in the direction in which sheets are fed is movable up and down, and wherein a facing position of the forward portion of said mounting means comes into direct contact with the each feed rollers when no sheets are contained in said containing section;

an urging means for urging said mounting means upward at least when the sheets are fed, such that the sheets are brought into contact with the each feed rollers; and a non-slip means arranged on an upper surface of the forward portion of said mounting means, wherein said non-slip means is in contact with a last sheet mounted on said mounting means, and said non-slip means including a base portion which locates at forward or backward of the two feed rollers in the sheets feeding direction and a facing portion facing to the roller axis aside the two rollers and being arranged in such a position that it does not come into direct contact with said two feed rollers even when no sheets are contained in said sheet containing section, wherein said non-slip means includes a sheet-shaped member and wherein said sheet-shaped member having an arbitary plane and having a predetermined thickness.

* * * * *